United States Patent [19]

Harrison

[11] Patent Number: 4,748,718

[45] Date of Patent: Jun. 7, 1988

[54] MOUNTING OF VEHICLE DOORS

[75] Inventor: Neil Harrison, Sotton Coldfield, United Kingdom

[73] Assignee: I.H.W. Engineering Limited, United Kingdom

[21] Appl. No.: 27,147

[22] Filed: Mar. 16, 1987

Related U.S. Application Data

[63] Continuation of Ser. No. 752,899, Jul. 8, 1985, abandoned.

[30] Foreign Application Priority Data

Jul. 11, 1984 [GB] United Kingdom ..... 8417721

[51] Int. Cl.[4] ..... E05D 7/12

[52] U.S. Cl. ..... 16/254; 16/382

[58] Field of Search ..... 16/382, 254, 270–272

[56] References Cited

U.S. PATENT DOCUMENTS

| | | | |
|---|---|---|---|
| 1,412,881 | 4/1922 | Ledwinka | 16/270 |
| 1,634,839 | 7/1927 | Marshall | 16/382 |
| 2,603,822 | 7/1952 | Evans | 16/243 |
| 3,319,691 | 5/1967 | Fisher | 411/90 |
| 3,590,419 | 7/1971 | Dargene | 16/235 |
| 3,969,789 | 7/1976 | Wize | 16/334 |
| 4,500,240 | 2/1985 | Moran et al. | 411/103 |

*Primary Examiner*—Paul A. Bell
*Assistant Examiner*—James L. Wolfe
*Attorney, Agent, or Firm*—Jones, Askew & Lunsford

[57] ABSTRACT

A hinge comprising a pair of hinge leaves pivotally connected together by a hinge pin, at least one leaf carrying a mounting bracket secured thereto by a single screw-threaded fixing, the fixing having a frusto-conical bearing surface which engages upon a corresponding frusto-conical surfaces on the leaf or bracket.

8 Claims, 3 Drawing Sheets

MOUNTING OF VEHICLE DOORS

This is a continuation of application Ser. No. 752,899, filed July 8, 1985 and now abandoned.

This invention relates to the mounting of vehicle doors, and in particular to a vehicle having at least one door mounted thereon by a pair of hinges.

In the manufacture of motor cars, in particular, it is desirable to attach the doors to the motor car body before the body is painted, so that the doors can be painted with the body. However, in subsequent assembly steps of the motor car, the presence of the doors mounted on the vehicle limits access to the interior of the vehicle, increases the width of the assembly track required, because the car must move with the doors open, and makes the trimming of the door, i.e., the fitting of windows, window winding mechanism, door locks and handles, and the internal padding and finishing of the door, more difficult. It is therefore desirable to be able to remove the door after painting for separate trimming and then to refit the completed door when assembly of the car is otherwise complete. With conventional vehicle door hinges, this is difficult to achieve, because the initial fitting of the door requires accurate positioning, and this accurate positioning will be lost when the door is removed.

The present invention provides a vehicle having at least one door mounted thereon by a pair of hinges, each hinge comprising a pair of hinge leaves pivotally connected together by a hinge pin, one leaf being connected to the vehicle body or door by a bracket secured to the leaf by a single screw-threaded fixing having a frustoconical bearing surface which engages a corresponding frusto-conical surface on the leaf or bracket, whereby the door may be detached from and accurately refixed to the vehicle by way of the fixings.

Preferably the brackets are attached to the door, each bracket having either a threaded hole to receive a bolt mounted on the hinge leaf, or a stud fixed thereto engageable by a nut rotatably mounted on the hinge leaf.

Another aspect of the invention provides a hinge comprising a pair of hinge leaves pivotally connected together by a hinge pin, at least one leaf carrying a mounting bracket secured thereto by a single screw-threaded fixing, the fixing having a frusto-conical bearing surface which engages upon a corresponding frusto-conical surface on the leaf or bracket.

In the vehicle according to the invention, the foors may be fitted in conventional manner before the vehicle is painted and then removed for separate treatment before being refitted to the completed vehicle by a simple operation which ensures accurate location of the door in the same position in which it was originally fitted.

Reference is made to the drawings, in which.

Figure 1:
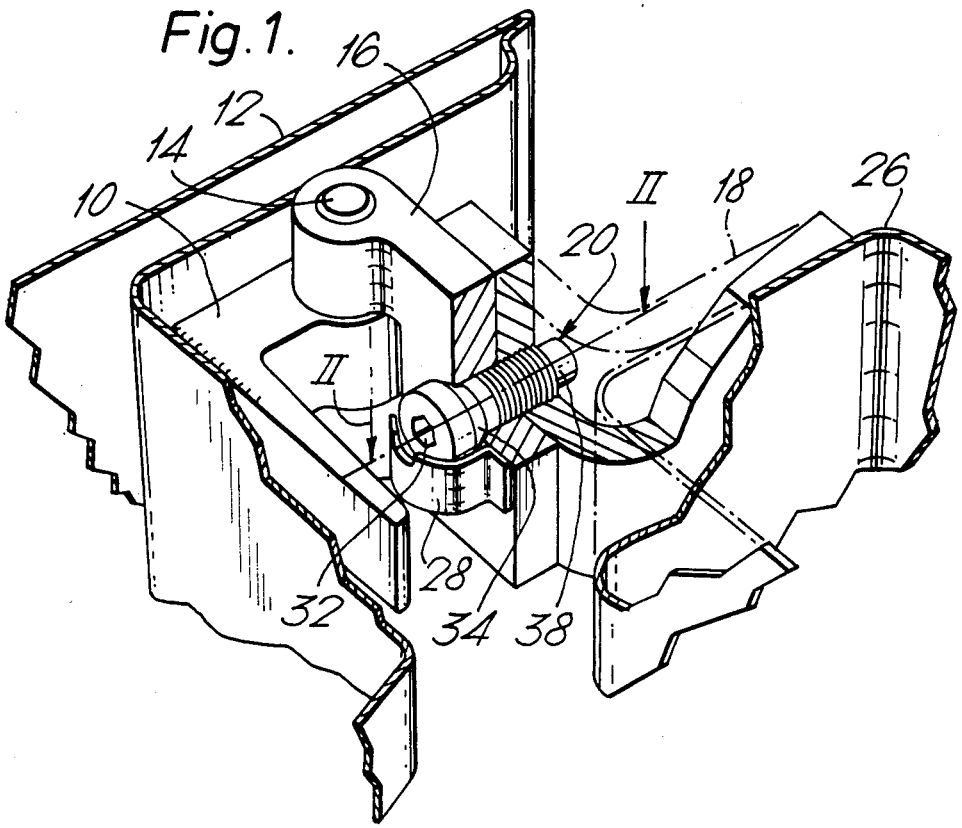
FIG. 1 is a perspective view, partially sectioned, of a portion of the vehicle door and of the vehicle body with hinge according to a first embodiment of the invention fitted therebetween.
Figure 2:
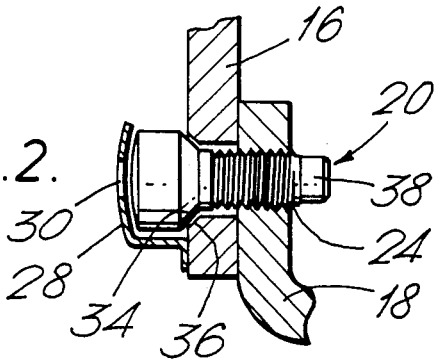
FIG. 2 is a sectional plan view taken along line II—II in FIG. 1.

Referring to FIGS. 1 and 2, the hinge shown therein comprises a male leaf 10 which is welded to a surface of the door 12 and connected via a hinge pin 14 to a female leaf 16. The female leaf 16 is attached to a mounting bracket 18 by means of a bolt 20 which passes through a bore 22 in the female leaf 16 and engages a threaded hole 24 in the bracket 18. The bracket 18 is bolted to the door post 26 by bolts (not shown). The bolt 20 is retained in the female leaf 16 by a keeper plate 28 welded to the leaf 16 and having therein an aperture 30 through which a hexagonal socket 32 in the head of the bolt can be engaged by a suitable hexagonal key for rotation of the bolt.

The underside of the head of the bolt 20 has a frusto-conical surface 34, and the bore 22 in the female leaf 16 is provided with a corresponding opposed frusto-conical face 36 which, when engaged by the surface 34 ensures that the bolt is precisely centered within the bore 22, which is sized so as to give a small clearance around the shaft of the bolt 20. It will be seen that, with a pair of hinges as described mounting each vehicle door, accurate realignment of the door relative to the vehicle door opening is ensured following removal of the door by loosening of the bolts 20.

In use, the hinges, complete with brackets 18 attached thereto, are attached to the door in conventional manner, by welding on the male leaves, and the female leaves 16 are bolted, after alignment, to the door post of the vehicle. Following painting of the vehicle, including the doors, the doors are then detached, by unscrewing the bolts 20, and removed for finishing, while the vehicle passes along the assembly line to be completed in conventional manner. The doors are then re-attached by means of the bolts 20, which are provided with nose portions 38 of reduced diameter to assist location of the brackets 18. Tightening of the bolts 20 will draw the door into exactly the same position as it was set in before the painting steps. Since each hinge includes only a single bolt 20, the door is effectively secured to the respective brackets at single locations which minimises the possibility of misalignment occurring on tightening of bolts 20.

Figure 3:
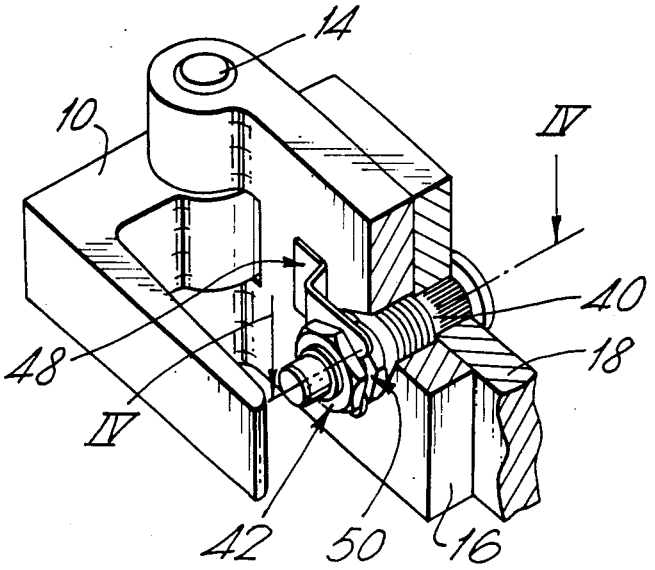
FIG. 3 is a perspective view, partly in section of a hinge according to a second embodiment of the invention.
Figure 4:
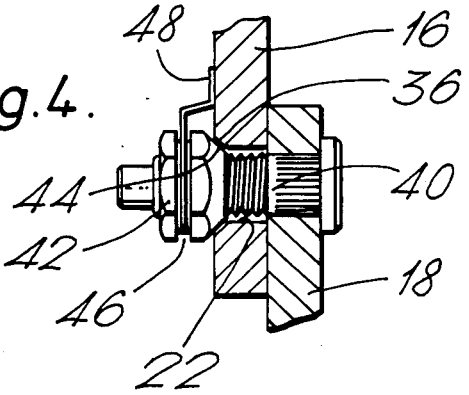
FIG. 4 is a sectional plan view taken along line IV—IV in FIG. 3.

An alternative arrangement is shown in FIGS. 3 and 4. Here, the bolt 20 is replaced by a stud 40, which is welded or, as shown, splined and press-fitted, into the bracket 18. The threaded stud 40 is engaged by a hexagonal nut 42 having on its underside a frusto-conical surface 44 corresponding to the frusto-conical surface 36 surrounding the mouth of the bore 22 in the female leaf 16. The nut has a circumferential groove 46 thereround and a nut retainer plate 48 is welded to the female leaf 16 to retain the nut in place on the leaf 16. The nut retainer has a slot 50, the sides of which rest within the groove 46 on the nut. Removal and re-attachment of the door is similar to that described with reference to FIGS. 1, 2 and 3, except that removal is effected with a spanner instead of a hexagonal key.

Figure 5:
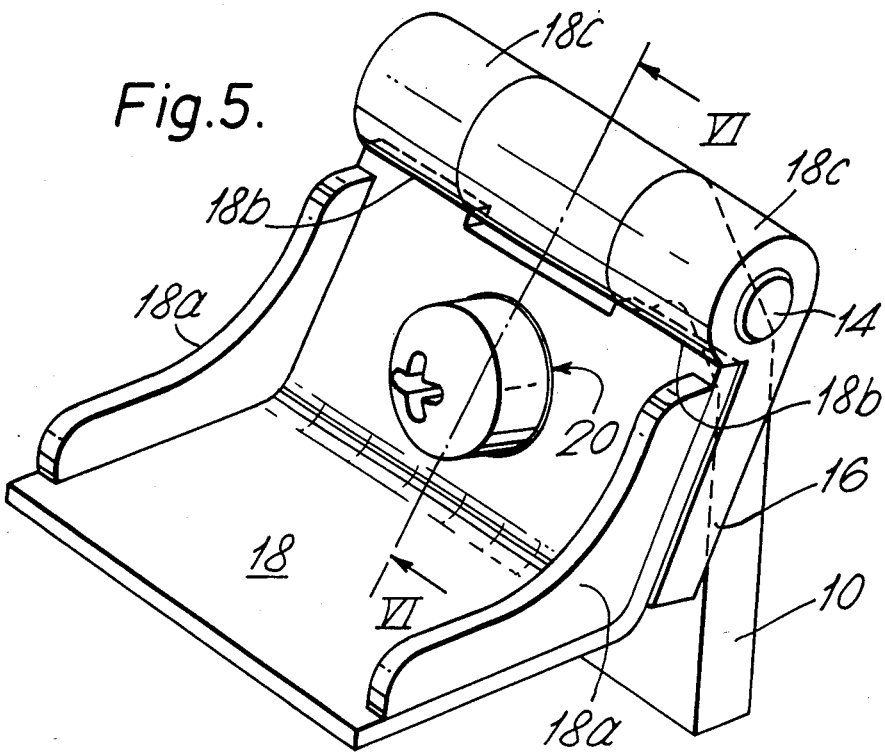
FIG. 5 is a perspective view of a hinge according to a third embodiment of the present invention.
Figure 6:
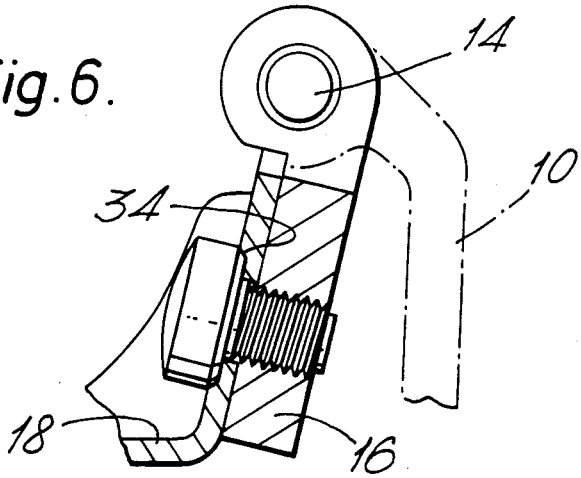
FIG. 6 is a part sectional side view taken along line VI—VI in FIG. 5.

A further embodiment is illustrated in FIGS. 5 and 6 wherein similar parts are designated by similar reference numberals.

The mounting bracket 18 is formed as a metal pressing having reinforcement side walls **18*a* welded in position. The bracket 18 is formed so as to have a pair of shoulders 18*b*. The hinge leaf 16 is formed with a screw-threaded bore to receive the bolt 20. The bolt 20 is provided with a frusto-conical surface 34 and the bracket 18 is provided with a co-operating frusto-conical face for the purposes described above. The hinge leaf 16 is provided with a pair of hinge pin sleeves 18c which protrude above the face of the leaf 16 against which the bracket 18 abuts. The location of shoulders 18b is such that the shoulders 18b and respective sleeves 18c are slightly spaced from one another when the bracket 18 and leaf 16 are connected by the bolt 20. In this way undesired relative rotation between the bracket 18 and leaf 16 about the bolt 20** is prevented.

What is claimed is:

1. A separable vehicle door hinge for hingedly connecting a vehicle door to a vehicle body, the hinge comprising:

a first hinge leaf having a mounting portion for attachment to one of said vehicle door or body;

a second hinge leaf hingedly connected to the first hinge leaf by a hinge pin;

the second hinge leaf having a leaf portion connected to the hinge pin and a mounting bracket portion detachably secured to said leaf portion by a single fixing means, the leaf portion and mounting bracket portion overlapping one another in face to face contact;

said fixing means having a frusto-conical bearing surface which engages upon a corresponding frusto-conical surface on one of said leaf portion and said mounting bracket portion, so that on tightening of the fixing means to clamp said portions in face to face contact said frusto-conical surfaces coact to align said portions relative to one another; and said mounting bracket portion having a mounting portion for attaching the second hinge leaf to the other of said vehicle door or body independently of said fixing means, such that after attachment of said mounting portion to said other of said vehicle door or body in certain alignment and on release of the fixing means, the leaf portion is separable from the mounting bracket portion in a radial direction relative to the hinge pin to permit separation of said vehicle door and body while leaving the mounting bracket portion attached to said other of said vehicle door or body, and such that the separated vehicle door and body can be subsequently reconnected in said certain alignment by reattachment of the leaf portion to the mounting bracket portion by said fixing means.

2. A separable vehicle door hinge for hingedly connecting a vehicle door to a vehicle body, the hinge comprising:

a first hinge leaf having a mounting portion for attachment to one of said vehicle door or body;

a second hinge leaf hingedly connected to the first hinge leaf by a hinge pin;

the second hinge leaf having a leaf portion connected to the hinge pin and a mounting bracket portion detachably secured to aid leaf portion by a single screw threaded fixing means, the leaf portion and mounting bracket portion overlapping one another in face to face contact;

the fixing means having a frusto-conical bearing surface which engages upon a corresponding frusto-conical surface on one of said leaf portion and said mounting bracket portion so that on tightening of the fixing means to clamp said portion in face to face contact said frusto-conical surfaces co-act to align said portions relative to one another, the mounting bracket portion having a mounting portion for attaching the second hinge leaf to the other of said vehicle door or body independently of the fixing means, and the mounting portion of said mounting bracket portion being located beyond said leaf portion, such that after attachment of said mounting portion to said other of said vehicle door or body in certain alignment and on release of the fixing means, the leaf portion is separable from the mounting bracket portion in a radial direction relative to the hinge pin to permit separation of said vehicle door and body while leaving the mounting bracket portion attached to said other of said vehicle door or body, and such that the separated vehicle door and body can be subsequently reconnected in said certain alignment by reattachment of the leaf portion to the mounting bracket portion by said fixing means.

3. A hinge according to claim 2, wherein the mounting bracket portion and leaf portion secured thereto are provided with co-operating formations for restraining relative rotation of the mounting bracket and leaf portions about the fixing means.

4. A hinge according to claim 3, wherein said fixing means comprises either a nut or a bolt having a head, and said frusto-conical surface of said fixing means is formed on said nut or said bolt head.

5. A hinge according to claim 4, wherein said second leaf includes retention means co-operable with said bolt head or nut of the fixing means and serving to retain said bolt head or nut on said leaf portion after separation of said leaf portion from the bracket portion.

6. A hinge according to claim 2, wherein said fixing means comprises one of a nut and a bolt having a head, and said frusto-conical surface of said fixing means is formed on said nut or said bolt head.

7. A hinge according to claim 6, wherein said second leaf includes retention means co-operable with said bolt head or nut of the fixing means and serving to retain said bolt head or nut on said leaf portion after separation of said leaf portion from the bracket portion.

8. A vehicle having at least one door mounted thereon by a pair of separable hinges, comprising:

each hinge comprising a first hinge leaf attached to one of the vehicle body or door, and a second hinge leaf hingedly connected to said first hinge leaf by a hinge pin and attached to the other of the vehicle body or door;

one of said hinge leaves comprising a leaf portion connected to said hinge pin and a mounting bracket portion detachably secured to said leaf portion by a single threaded fixing means, the leaf portion and mounting bracket portion overlapping one another to be in face to face contact;

said fixing means having a frusto-conical bearing surface which engages upon a corresponding frusto-conical surface on one of said leaf portion and said mounting bracket portions, so that on tightening of the fixing means to clamp said portions in face to face contact said frusto-conical surfaces co-act to align said portions relative to one another;

said mounting bracket portion having a mounting portion for attaching the second hinge leaf to the other of said vehicle body and said door independently of said fixing means; and the mounting portion of said mounting bracket portion being located beyond said leaf portion such that after attachment of said mounting portion to said other of said vehicle body or door member in certain alignment and on release of the fixing means, the leaf portion of each hinge can be separated from its respective mounting bracket portion in a radial direction relative to the hinge pin to permit separation of said door from said vehicle body while leaving the mounting bracket portion attached to said other of said vehicle body and door member, so that the separated door can be subsequently reconnected in said certain alignment to the vehicle body by reattachment of each leaf portion to its respective mounting bracket portion by said fixing means.

* * * * *